United States Patent [19]

Sprecace-Pantoli

[11] Patent Number: 4,693,445

[45] Date of Patent: Sep. 15, 1987

[54] CONCRETE AND CONSTRUCTION SYSTEM AND MODULAR PLANK ELEMENT FOR THE CONCRETE FORMWORK THEREOF

[76] Inventor: Enio Sprecace-Pantoli, Colinas del Tamanaco, Calle Sta. Cruz, Quinta "Enti" Caracas 1061, Venezuela

[21] Appl. No.: 892,121

[22] Filed: Jul. 30, 1986

[51] Int. Cl.[4] ..... E04G 11/00

[52] U.S. Cl. ..... 249/19; 249/27; 249/47; 249/189; 249/196; 249/219 R

[58] Field of Search ..... 249/192, 189, 194, 196, 249/44, 47, 219 R, 19, 27

[56] References Cited

U.S. PATENT DOCUMENTS

| | | | |
|---|---|---|---|
| 958,419 | 5/1910 | Mowat | 249/19 |
| 1,300,436 | 4/1919 | McKay | 249/219 R |
| 1,339,912 | 5/1920 | Ambursen | 249/192 |
| 1,616,357 | 2/1927 | Engstrom | 249/194 |
| 2,801,454 | 8/1957 | Troiel | 249/192 |
| 4,022,420 | 5/1977 | Pace | 249/194 |

*Primary Examiner*—Bernard Nozick

*Attorney, Agent, or Firm*—Karl F. Ross; Herbert Dubno

[57] ABSTRACT

A falsework for concrete structures is formed by providing tubular elements at longitudinal edges of metal planks and corner units and providing slots in these tubular elements such that hooks engaged in these slots can brace metal plates against two adjoining such elements while the metal plates are supported by bars welded to the elements below the slots.

13 Claims, 35 Drawing Figures

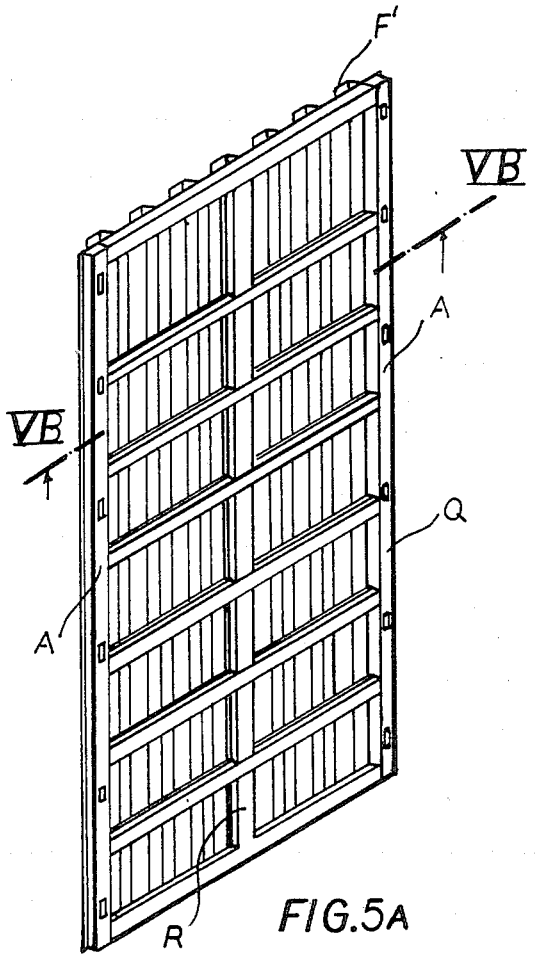
FIG.5A
FIG.5B
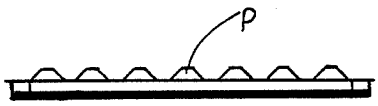
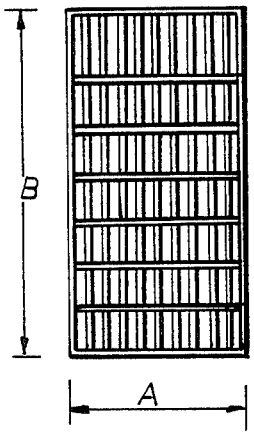
FIG.5c

FIG.6B
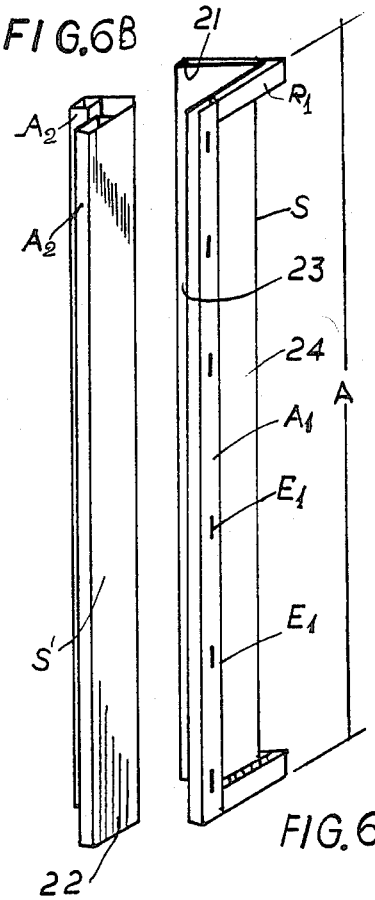
FIG.6A
FIG.6C
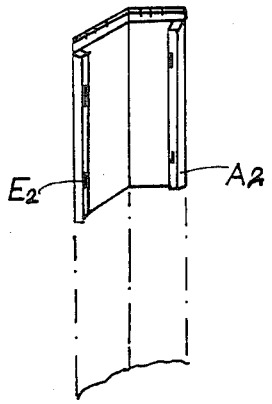

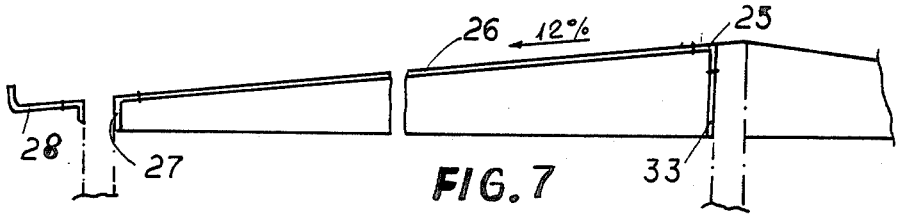
FIG. 7
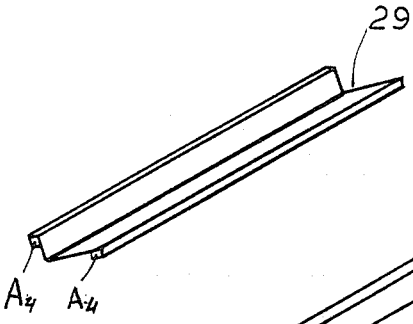
FIG. 7A
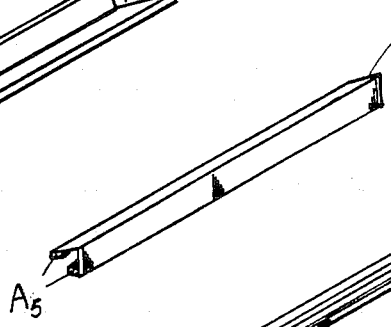
FIG. 7B
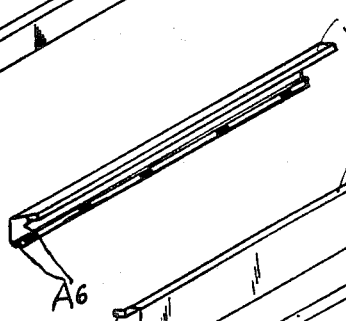
FIG. 7C
FIG. 7D
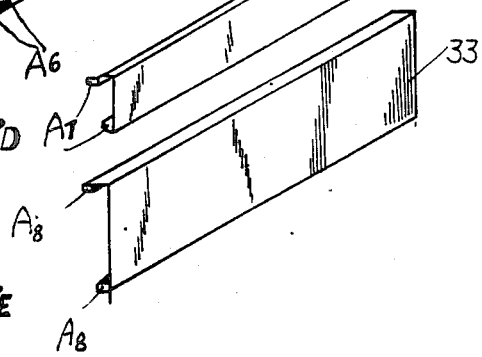
FIG. 7E

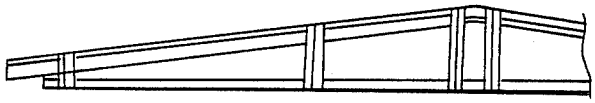
FIG. 9
FIG. 9A
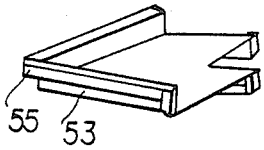
FIG. 9B
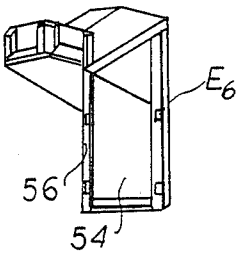

CONCRETE AND CONSTRUCTION SYSTEM AND MODULAR PLANK ELEMENT FOR THE CONCRETE FORMWORK THEREOF

FIELD OF THE INVENTION

My present invention relates to concrete formwork and, more specifically, to a modular formwork or falsework for the production of concrete structures or portions thereof and to a concrete building system using such falsework.

BACKGROUND OF THE INVENTION

It is known to mass produce housing units with iron or aluminum plank formwork or falsework constituting concrete molds and which are joined at the construction site by means of insertable connecting elements to assemble the molds.

Plank mold-forming elements are thus assembled to permit the formation of a lower part of the structure and when the concrete has hardened sufficiently, the connecting elements are removed to allow disassembly of the formwork and new erection thereof to provide an upper portion of the structure which may include the roof, or upon which the roof can be fabricated from different materials.

Conventional plank formation which has several drawbacks:

Firstly, the planks can be relatively heavy so that plank formations of large dimensions can only be assembled with machinery and equipment for manipulating the planks.

Secondly, the method and means for connecting the plank forms at their edges can be complex and can require the use of specialized personnel. Moreover, if the interconnection is not proper, the concrete structures which result may have an unsatisfactory appearance or can result in cracks in the concrete structure which may be detrimental to the building unit.

Thirdly, the weight and dimensions of prior art formations can cause them to deform, thereby making use of these elements in formations which is difficult and prevents them from being reused a sufficient number of times. This can greatly increase the final cost of structures made using such elements deform, attempts can be made to repair them, but this can create new problems since the surfaces which result generally are not sufficiently smooth. Also, the straightening operation increases increases the cost and is time consuming.

Earlier systems of erecting concrete structures utilizing molds formed by planks of the type described is that, once the wall molds have been assembled and the concrete poured and hardened, the fabrication of a new mold for the roof is required when it is to be made of concrete when, however, the roof is to be made of other materials, considerable time must pass before the roof is erected.

OBJECTS OF THE INVENTION

It is the principal object of the present invention to provide an improved plank system for the formation of plank molds for the erection of concrete structures whereby the drawbacks of earlier systems are avoided.

Another object of the invention is to provide a lightweight rigidity falsework for concrete forms, which is less susceptible to deformation, does not require manipulation by machinery and can be assembled in a modular way with other elements to erect the concrete form.

Yet another object of the invention is to provide a plank mold system which permits the pouring of concrete for both the walls and roof parts of a structure in a single operation and which utilizes plank mold elements that are sufficiently light and of appropriate dimension to be easily handled by workers without equipment and machinery, but which, at the same time, have sufficient structural strength to enable them to be repeatedly used without deformation.

Still another object of my invention is to provide a plank mold system which permits manipulation of the component parts manually, but which is, nevertheless, self-supporting and capable of supporting the weight of concrete during and subsequent to its pouring without deformation until the plank molding is disassembled later.

SUMMARY OF THE INVENTION

According to the invention, a falsework for concrete construction, comprises:

a plurality of plank elements, each having a rectangular sheet having a concrete-facing mold-forming side and a reverse side, a pair of flat tubular elements affixed to the sheet along opposite longitudinal edges thereof on the reverse side, said tubular elements each having a longitudinally extending outwardly projecting flange, and a plurality of equally spaced slots formed in a side of each of the elements turned away from the sheet and elongated in the longitudinal dimension of the respective element;

a coupling member interconnecting the plank elements with the flanges disposed in substantially contiguous relationship and two the tubular elements being substantially coplanar, the coupling member being formed as a generally rectangular plate overlying the sides of the coplanar tubular elements and formed with respective notches opening along a common edge of the plate in alignment with respective ones of the slots of the coplanar tubular elements; and respective hooks each having a short leg, a long leg connected to the short leg and parallel thereto, and an arm connecting the legs having a length substantially equal to the sum of the thickness of the side and the thickness of the plate, the arm reaching through a respective slot and the short leg engaging the respective side of the respective tubular element on a face thereof turned away from the plate, the long leg engaging the plate on a face thereof turned away from the tubular elements and the arms being received in the respective notches of the plate.

The tubular elements are generally upright and below each of the slots engaged by a respective hook, a respective support bar is welded at a distance from a lower edge of the slot which is at most one-third of the height of the plate, the notches being of rectangular outline and of a height of about one-third of the height of the plate. The bars have a thickness substantially equal to that of the plate. The plate can have a length substantially equal to twice the width of one of the tubular elements. The legs of the hook preferably have rounded edges. Plank elements can each have transverse elements extending in mutually parallel vertically spaced relationship between the tubular elements of the respective plank element and affixed to the respective sheet thereof.

Each plank element is formed with respective vertical struts between pairs of the transverse elements of the respective plank element and affixed to the respective sheet thereof intermediate the respective tubular elements.

Transverse elements of each plank element include upper and lower marginal transverse elements lying respectively along upper and lower edges of the plank element and formed with spaced apart slots each adapted to receive one of the hooks.

At least one end element adjoins at least one of the plank elements, the end element being formed with a rectangular sheet formed with two panels at a right angle to one another and having a concrete-facing mold-forming side and a reverse side, and respective such tubular elements formed along edges of the panels and provided with the slots, the tubular element of a respective one of the panels being affixed to a tubular element of one of the plank elements by a respective one of the bars and a respective pair of the hooks.

The present mold-forming system allows for the pouring of the concrete for both the walls and the roof in the same pouring operation.

The plank elements and end or corner elements of the invention are of a modular size both as to length and as to width so that the length and width dimensions of the sheets and panels are 30 cm or multiples of 30 cm such that combinations of panels and sheets can be made so that they always fit with one another in a practical and simple way.

The openings or slots which are used to join the plank elements to one another are also separated in modular units, e.g. by 30 cm from opening to opening and 15 cm from an edge so that the distance between the last opening of a panel and the first opening of another will also measure 30 cm.

Using modular components of this type, it is easy to obtain combinations of pieces so that lengths, widths and heights of the structures and the floor plans can be increased simply by the additional of more elements and practically any single structure can be formed by a concrete mold fabricated in accordance with the invention, no matter what its area might be needing, only such bracing as may be required for large spaces, high walls and generally, building with large lights.

The system of the invention thus allows the fabrication of footing walls and both large and small buildings and, as especially adapted for use in the production of low-cost housing, hospitals, prisons, bank vaults, warehouses, shopping centers and public and private buildings of all dimensions, heights, lights or openings.

BRIEF DESCRIPTION OF THE DRAWING

The above and other objects, features and advantages of the present invention will become more readily apparent from the following description, reference being made to the accompanying drawing in which:

FIG. 5A is a perspective view of another plank element utilizing a corrugated sheet;

FIG. 5B is a cross-section taken along the line VB—VB of 5A;

FIG. 5C is an elevational view of the reverse side of the element of FIG. 5A;

FIG. 6A is a perspective view of an outside corner element of the mold adapted to be joined to the plank element in forming a wall of the mold;

FIG. 6B is a perspective view of an inside corner element adapted to form a corner of the mold with the outside element of FIG. 6A;

FIG. 6C is a diagrammatic perspective view of the inside corner element;

FIG. 7 is a diagram showing the layout of a roof mold structure which can be made by elements forming the eaves, internal slope and external corner according to the invention;

FIGS. 7A–7E are perspective views of variations of these elements;

FIG. 9 is an elevational view illustrating the locations of the eave and ridge seals;

FIG. 9A is a perspective of the eave seal;

FIG. 9B is a perspective view of the ridge seal;

SPECIFIC DESCRIPTION

Figure 1:
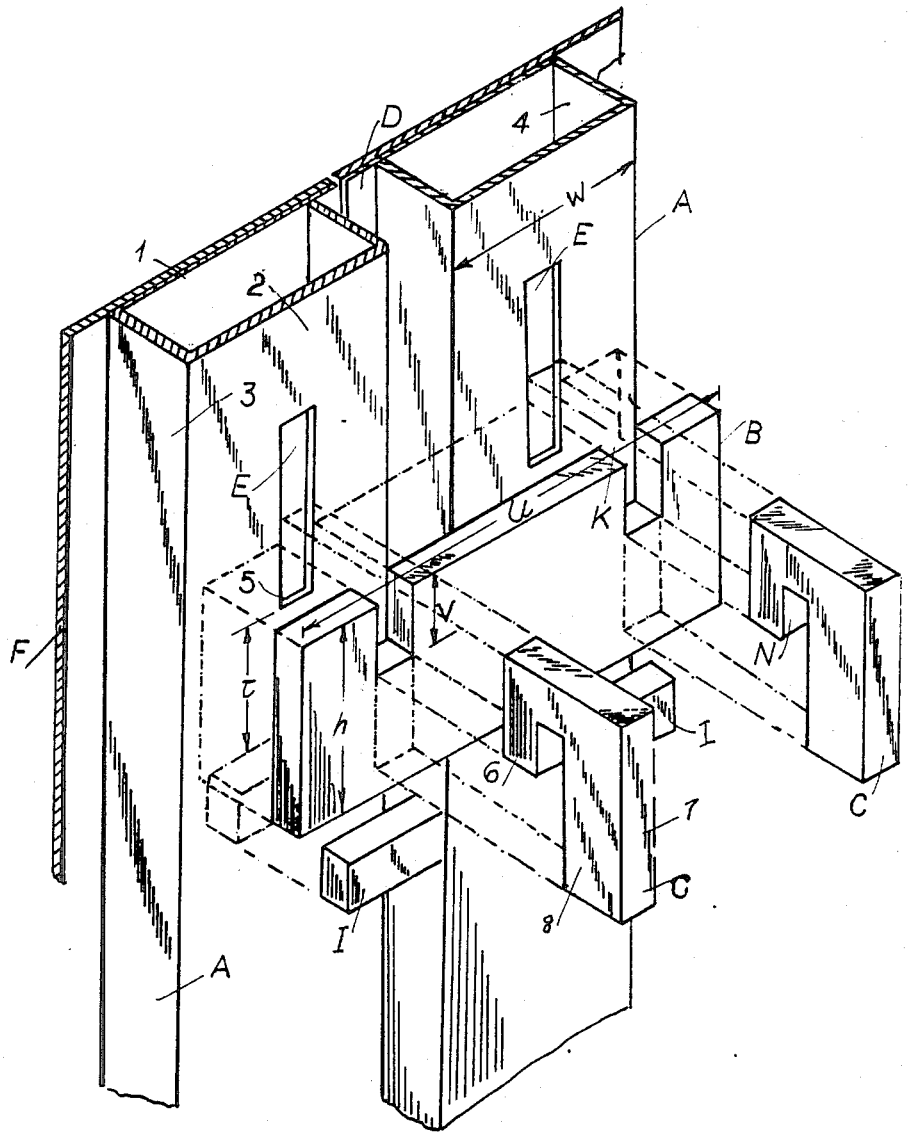
FIG. 1 is a perspective exploded view of the system in accordance with the invention.

The basic structural elements for the plank mold system of the invention in the connection of the modular elements whether they are plank elements, corner elements, or roof elements has been illustrated in FIG. 1 and consists of modules A in the form of tubular elements of rectangular cross section having wide sides 1 and 2 and narrow sides 3 and 4. From the wide side 1 which abuts and is welded to a rectangular sheet F has a longitudinal flange or border D extending along the edge of plank element so as to be contiguous with a similar edge of the adjoining plank element as has been shown in FIG. 1.

Figure 4A:
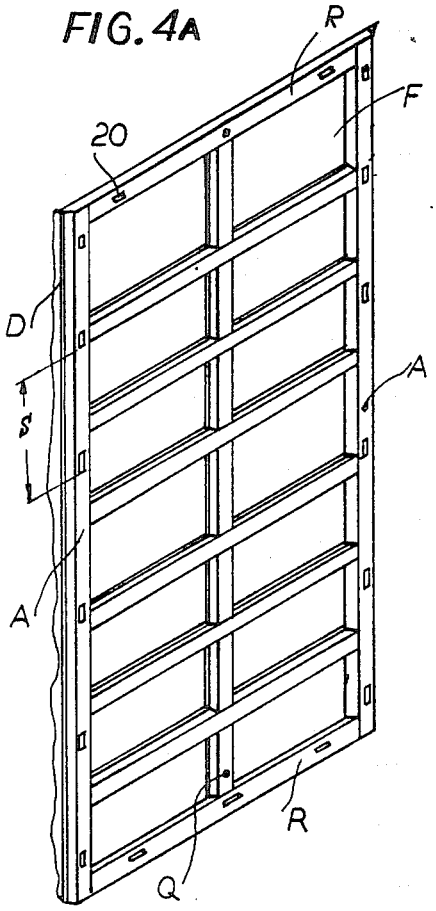
FIG. 4A is a perspective view of a plank element according to the invention.

The side 2 which is opposite side 1 has a succession of vertical elongated openings or slots E with a modular spacing s which can be 15 cm or a multiple thereof (See FIG. 4A). The sheet F can be made of iron or aluminum as can the tubular elements A. The slots E have lower edges 5 below which support bars I are welded at a distance t which is at most one-third of the height h of a rectangular plate B whose length u is approximately twice the width w of the side 2.

The rectangular parallelepiped plate B is thus supported by the bars I and can have a pair of rectangular notches K which extend vertically, are spaced apart and are open at the front, top and rear sides of this plate, the notches K having lengths v which are approximately one-third the height h. These notches and the slots E receive hooks C which constitute the joining elements, each hook C is a solid parallelepiped and quadrangular with its corners or edges rounded as will be described in connection with FIG. 2.

For the embodiment illustrated in FIG. 1 it can be seen that each hook C has a short leg 6 parallel to a large leg 7 and is connected to the large leg 7 by an arm 8 at right angles to these legs. The legs are thus separated by an opening N.

Thus the hook can be inserted into the slot and will have its short arm 6 lie against the internal surface of the side 2 while the large arm is for retaining the plate against the tubular element H.

Figure 2:
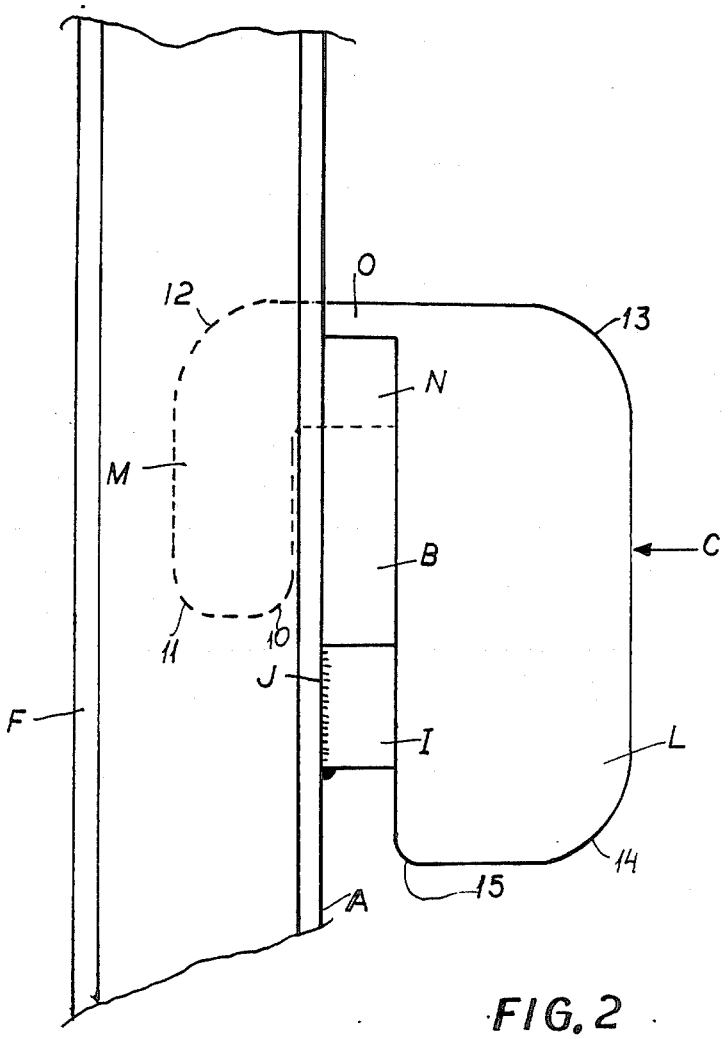
FIG. 2 is a side-elevational view in this connection system showing the hook in a different configuration.

In FIG. 2 the preferred configuration of the hook C has been shown. Here the short arm M can be seen to have rounded lower corners 10 and 11 and a rounded upper corner 12 while the connecting piece O is rounded at 13 at its junction with the large arm L. Lower edges 14 and 15 of the large arm are likewise rounded.

Figure 3:
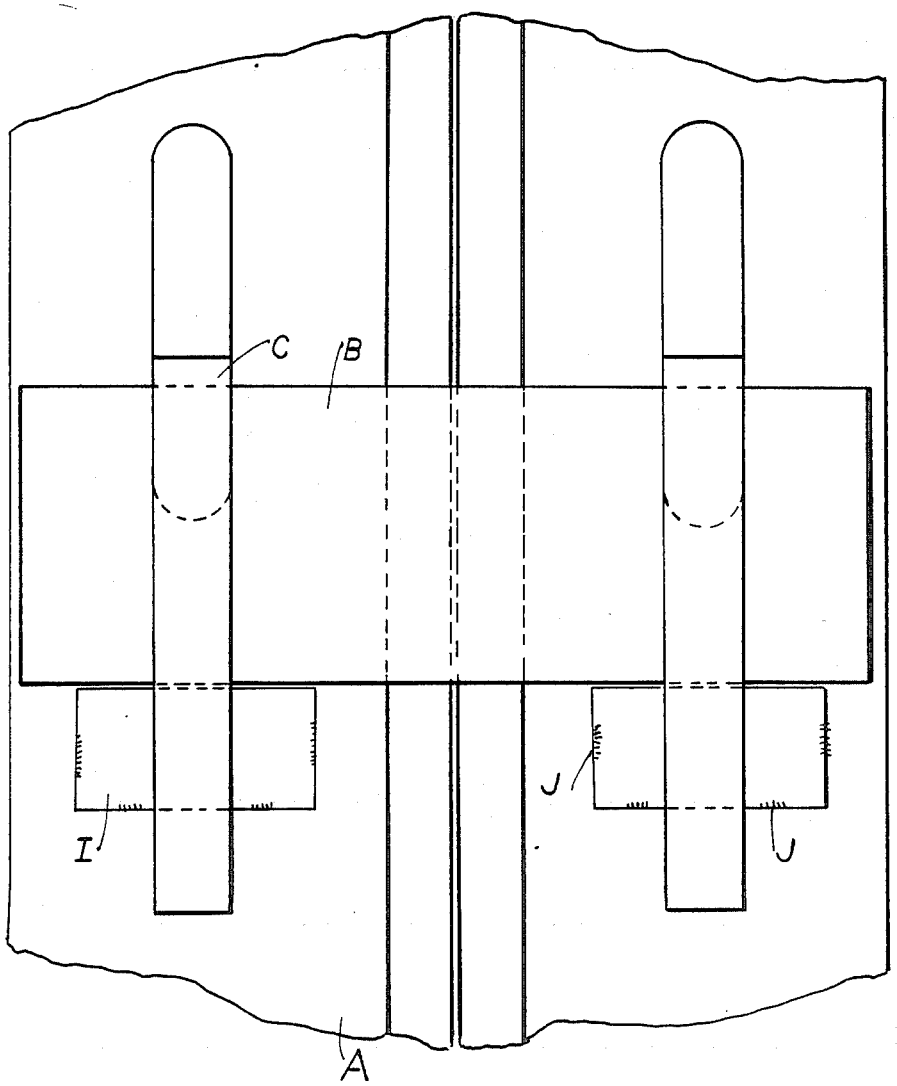
FIG. 3 is an elevational view of the connection system.

In FIG. 3, I have shown the weld junctions J at which the tubular elements H are welded to the bars I.

Figure 4B:
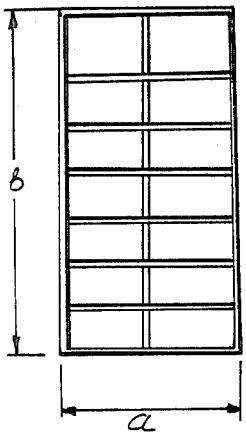
FIG. 4B is an elevational view of the reverse side thereof.

A typical plank element utilizing the connection system of FIGS. 1 through 3 have been shown of FIGS. 4A and 4B. Here, it is apparent that in addition to the columns A at the opposite longitudinal edges of the sheet F, the plank element is braced by transverse elements R which can be uniformly spaced apart in the vertical direction and are parallel to one another. Horizontal slots 20 which can be engaged by similar hooks are provided, preferably 15 cm in from the longitudinal edge and spaced apart by an integral number of modular dimensions of 15 cm, e.g. 30 cm. The transverse elements which are inwardly of the ends of the panel element, do not need such slots as has been shown and can be braced in pairs by structures Q.

The width and length dimensions a and b of the panel elements have been shown in FIG. 4B and are modular, i.e. each is an integral number of 30 cm units.

The plank elements of FIGS. 1 through 3, 4A and 4B, of course, can be used to erect walls of substantially any size within the modular concept by joining such elements in contiguous relationship, the widths and lengths a and b all being integral multiples of the modular increment of say 30 cm. The resulting walls are spacedly juxtaposed with opposing walls, similarly constructed, to define a mold, form or falsework into which reinforcing rods or mats can be inserted and which can then be filled with concrete. When the concrete hardens, the hooks are removed, the formwork is disassembled and can be reassembled for other parts of the resulting structure or other structures. As can be seen from the FIGURES described below, especially FIGS. 6A and 6B, corner elements can be provided at the corners of the structure, these having sheets which are bent to define panels lying at an angle of 90 degrees.

It will also be apparent that, aside from the advantages which result because the objects of the invention are attained, the plank elements can have a maximum width of 1.20 meters so that each plank element can have a maximum weight of 98 kg and is, therefore, easy to handle by a worker. To erect the mold walls, adjacent edges of the plank elements are positioned so that the tubular elements A are coplanar at their sides 2. A plate B is placed against each pair of coplanar sides and the hooks C are inserted into each slot E of a tubular element with which one of the notches K registers. The hooks are then permitted to drop into the notches to thereby lock the assembly together and form a rigid connection capable of resisting the stress produced by the pouring of the concrete and its hardening in the space between one set of plank elements and an opposing set of plank elements. As can be seen from FIG. 5, the metal sheets F can be replaced by sheets F′ which are corrugated instead of smoothed, the preferred corrugations having the configuration of isosceles trapezoids whose bases extend horizontally. The inclined sides of the trapezoid form vertical flanks. The crests P (FIG. 5B) leave troths in the concrete structure of the complimentary shape and this shape, apart from being decorative, will have greater surface area than a flat wall, with a portion always being shaded. The corrugated sheets impart a corrugated finish to walls and ceilings on all surfaces of the concrete at which the corrugated plank elements are used. The corrugated plank elements can be employed with smooth-sheet plank elements to vary the contours and finish of the wall from interior to exterior or from one region along the exterior to another or from one region along the interior to another.

FIG. 6 shows that the corner piece S is formed by a sheet which can be corrugated or smoothed along its surface 21 or 22 adapted to define the mold wall. The corner pieces S and S′ are used respectively for external and internal corners and comprise two panels 23 and 24, for example, at a right angle to one another. Along the longitudinal edges, tubular columns $A_1$ tubular columns are provided as has been described to cooperate with bent transverse members $R_1$, each of which can be formed with slots $E_1$ as has been described.

In FIG. 6B the bent sheet of the corner section $S^1$ has vertical tubular elements $A_2$ which can also be provided with slots at the side at which connection to adjoining elements is desired but which cannot be seen in these FIGURES but are visible at $E_2$ in FIG. 6C.

Figures 8, 8A, 8B:
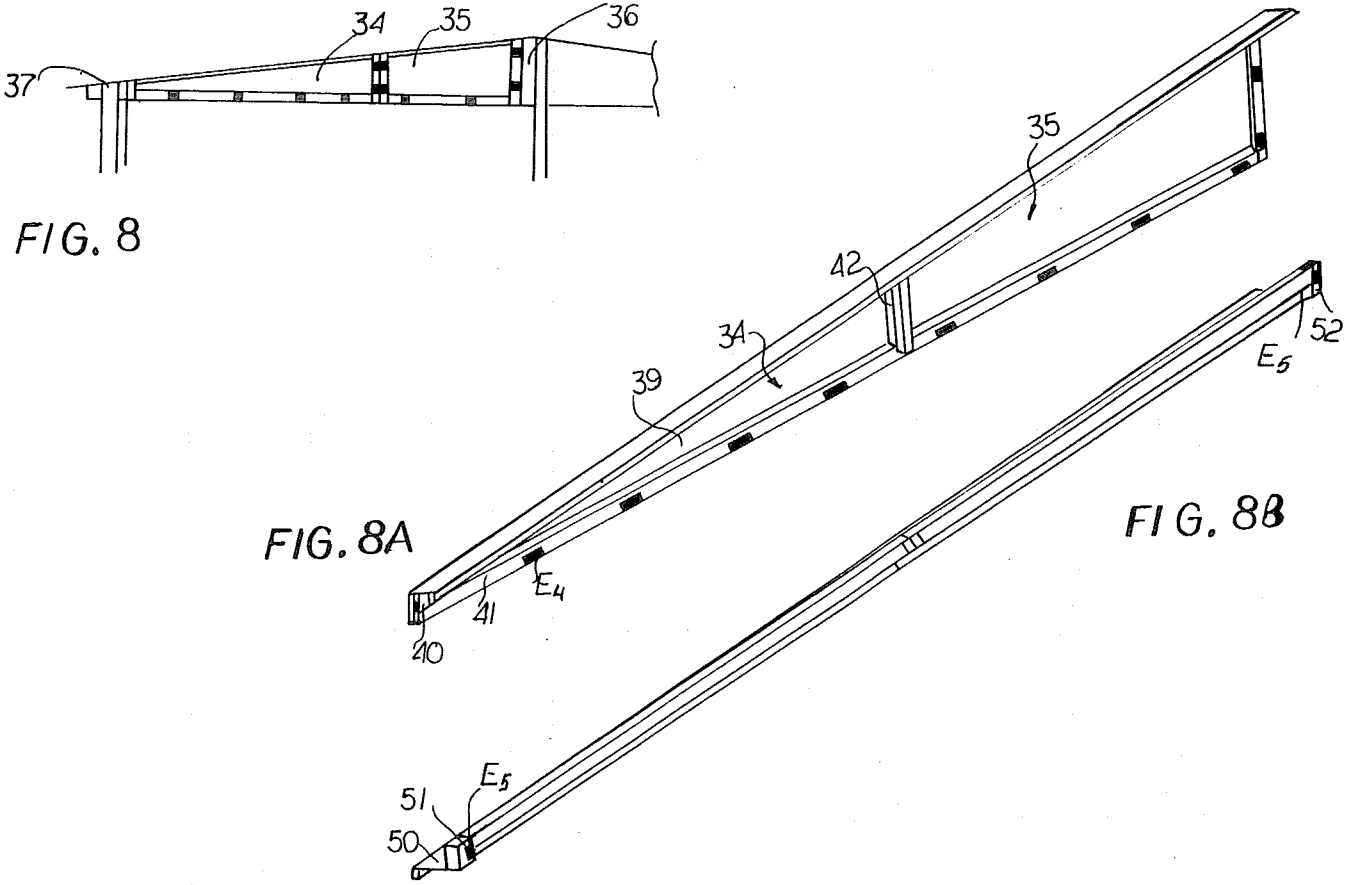
FIGS. 8 and 8A show the end panel elements of a roof mold structure in accordance with the invention.
FIG. 8B is a perspective view of an external corner therefor.

Referring now to FIGS. 7, 8 and 9 and the details 7A through 7E, 8A, 8B and 9A, 9B it will be apparent that the roof forming or upper components of the plank elements are designed with similar characteristics to the corner piece S or S′ to which the flange is added to allow for the formation of the eaves or for ceiling support.

Figure 11:
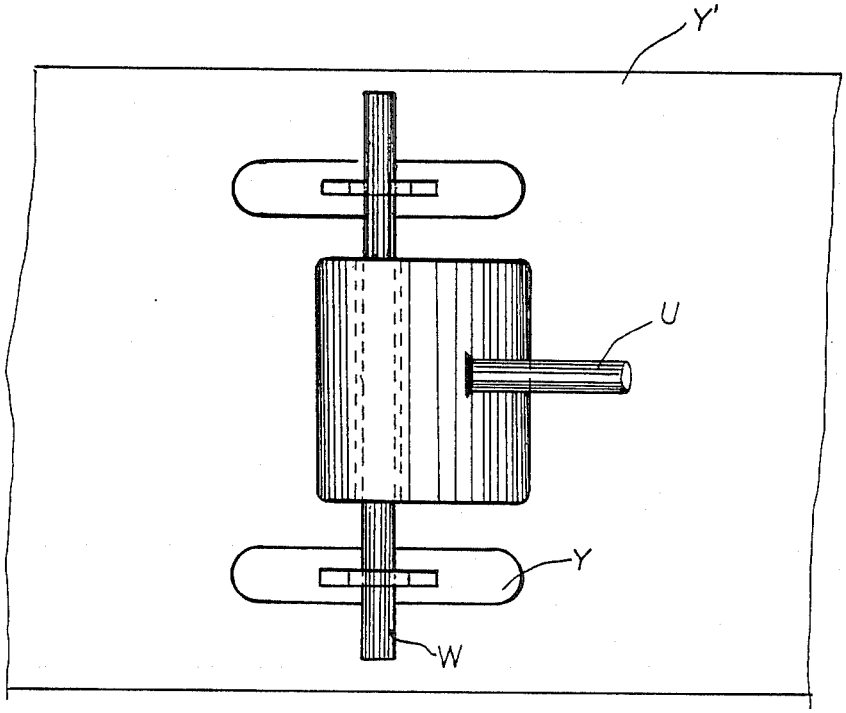
FIG. 11 is a plan view of a device in accordance with the invention for covering sides, sills and lintels of doors and windows in accordance with the invention.
Figure 12:
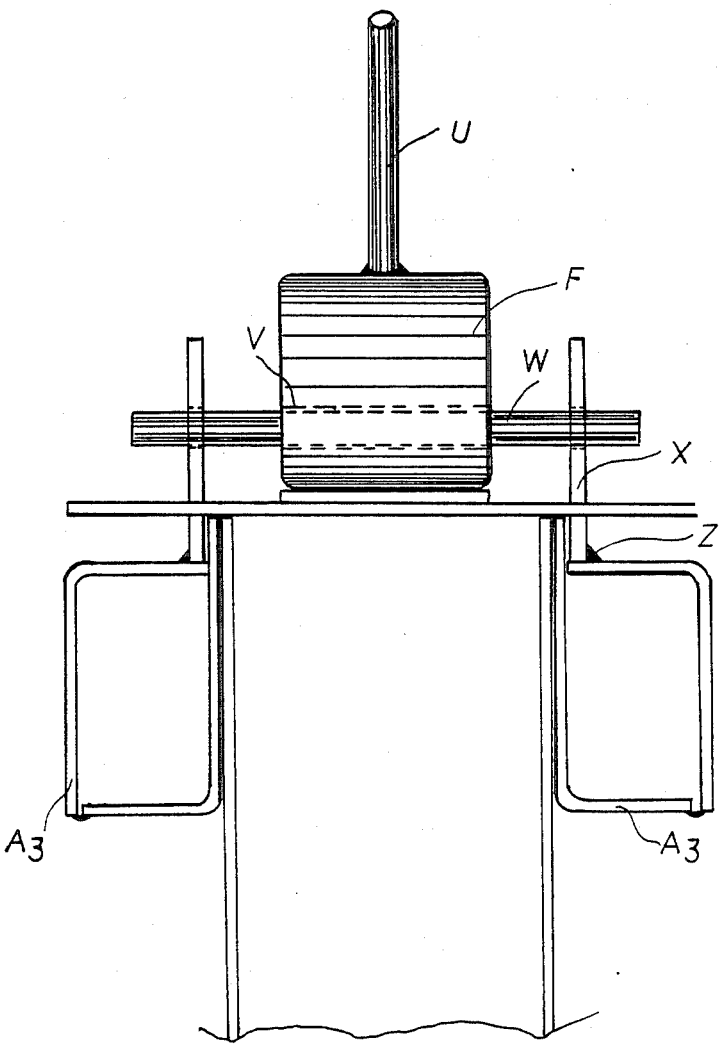
FIG. 12 is a front elevational view of the device of FIG. 11.
Figure 13:
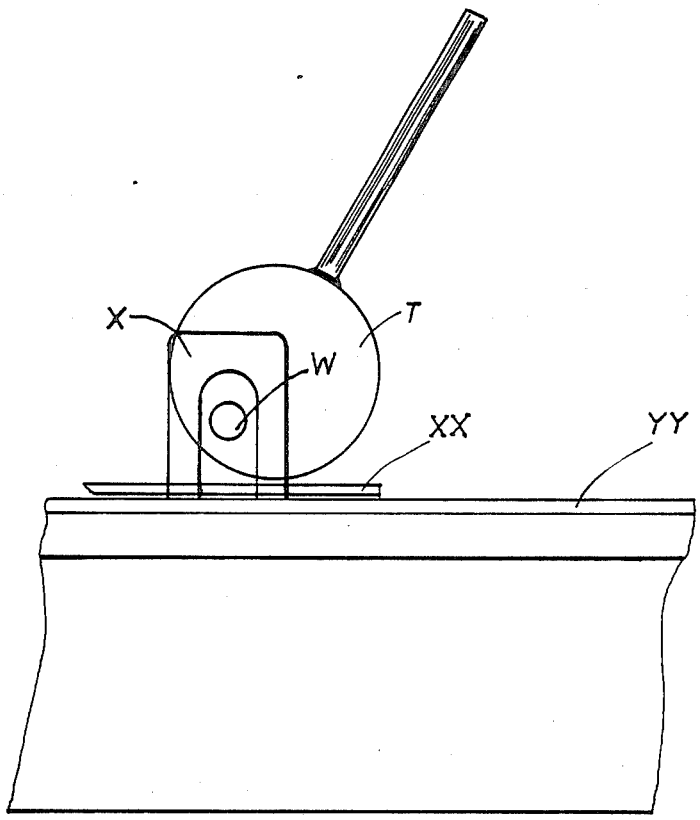
FIG. 13 is a side elevational view thereof.

In FIGS. 11, 12 and 13, I have shown a device of the invention as used to cover the sides of the sills, lintels and frame-forming members defined by the plank elements.

In these cases, the device comprises a solid, cylindrical body T whose diameter is approximately equal to its height and which has a horizontal geometric axis and a cylindrical perforation V coaxial with this geometric axis and disposed so that that the cylinder T forms a lever which rotates about the rotational axis or pin W introduced into the cylindrical bore V with projecting ends of the shaft W extending into openings in lugs which pass through elongated perforations Y in the plate XX. The lugs can be welded at 2 to the tubular elements $A_3$ which flank or form the frame of the opening.

An arm U is welded to the periphery of the cylinder T. When the plank molding is assembled, a sheet XX is interposed between a plate YY whose openings clean the lugs X which are fastened, as described, to the tubular elements of the planks. The arm U is swung until the assembly is in place and concrete can be poured.

By pulling the arm downwardly, the cylindrical body T describes a cycloidal path to press the sheet XX against the window or door opening YY.

The pressure exerted by the cylinder T in combination with the natural elasticity of the plate XX maintain the cover sheet YY pressed against the elements of the plank molding closing the ends of the molds in these regions to allow the concrete to be poured.

Once the concrete has hardened, the handle U is rotated in the opposite direction to loosen the pressure against the plate XX whereupon the shaft W can be withdrawn and the sheet YY removed when the plank elements are to be disassembled.

A low-cost building can be erected with the plank molding system of this invention using on its base a floor slab of reinforced concrete upon which the concrete walls can rest.

From the floor slab, an electro-welded reinforcing network can project into the mold assembled from the plank elements as well as conduit for electric lines, water and sewer pipes.

All of the walls and the ceiling can be poured simultaneously and for one, or more, stories of the building simultaneously. Upon disassembly of the plank formwork, finishing can commence with additional or intermediate stages, i.e. any necessary waterproofing, placement of sanitary fixtures, laying of ceramic tiles on floors or walls, installation of electrical connections and cables, installation of door and window frames and painting can be effected.

In FIG. 7, I have shown the overall construction of the formwork for producing a roof, illustrating that it is assembled from an internal corner piece 25, an inclined flat piece 26, an external corner piece 27 and an even structure 28, each of these elements can be formed from a sheet to which tubular elements provided with slots is included on which the tubular elements can be formed directly as, for example, the tubular elements $A_4$ on the eave-forming member 29 of FIG. 7A, the tubular elements $A_5$ of the angle member 30 forming an inside corner.

The tubular elements of the angle member 31, forming another corner piece, the tubular members $A_7$ of member 32 (FIG.7D) constituting a ridge structure and the tubular members $A_8$ forming a ridge panel 33 which is also visible in FIG. 7.

Figure 10:
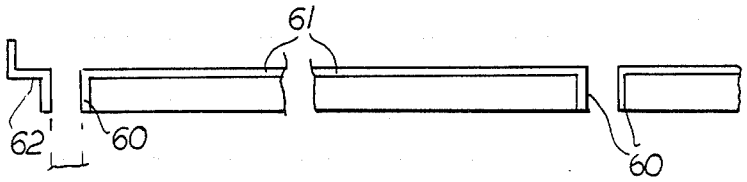
FIG. 10 is a diagram illustrating the layout of the internal and external corner pieces in accordance with the invention.
Figure 10A:
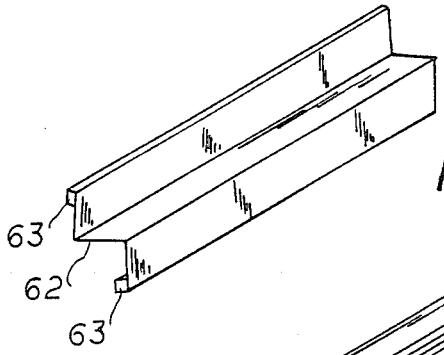
FIGS. 10A and 10B are diagrammatic perspective views showing the internal and external corner pieces.
Figure 10B:
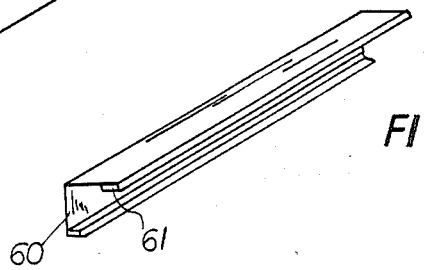

At the ends of the roof, the mold may be formed by a system as shown in FIG. 8 which comprises two sections 34, 35 connected to a ridge member 36 at one seal and to an eave structure 37 (FIG. 7A), at another seal as is visible from FIG. 8A, the section 34 can comprise a sheet 39 which is bent to the desired configuration and is provided with tubular members 40, 41 and 42 all have which have slots $E_4$ for interconnection to plate B to adjoining panels in the manner described. The member 35 is constructed similarly. A splash plate or eave can be formed at the end as well by a member such as has been shown in FIG. 8B which comprises a sheet 50 with tubular members 51 and 52 at its ends having the slots $E_5$, for example, for receiving hooks of the type shown. FIGS. 9A and 9B show suitable eave and rides seals 53 and 54 with tubular members 55 and 56 which can have slots, e.g. as shown at $E_6$ joining to other roof-forming members in constructing as illustrated in FIG. 9. FIG. 10 shows the arrangement of the mold elements for the formation of a flat roof. Here the members can be corner pieces of the type which have been described and are coupled to plank elements 61 by the means already described. The corner elements are illustrated at 60 in FIG. 10B as well and are seen to have tubular elements 61 along their longitudinal edges and provided with the usual slots which are not visible in this FIGURE. The eave-forming element 62 is also seen in FIG. 10A and has tubular element 63 with respective slots at its longitudinal edges.

Figure 14A:
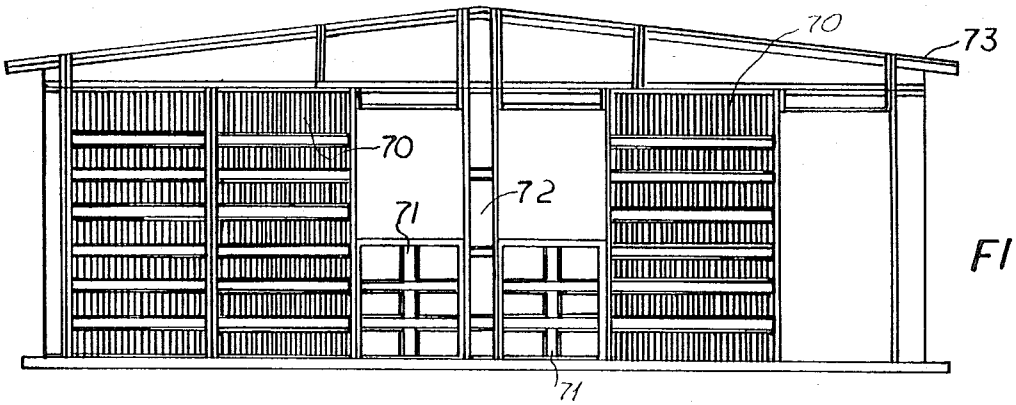
FIG. 14A is a front view of a mold structure in accordance with the invention for the fabrication of a house with a sloping roof illustrating how the panel elements are connected together.
Figure 14B:
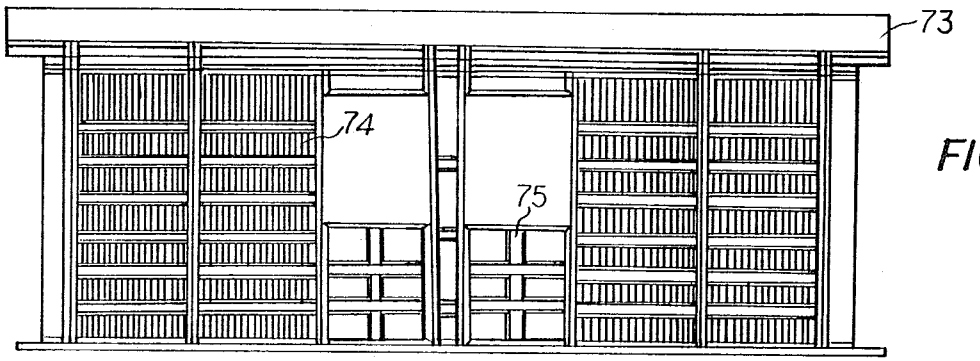
FIG. 14B is a side view of the house mold.
Figure 15:
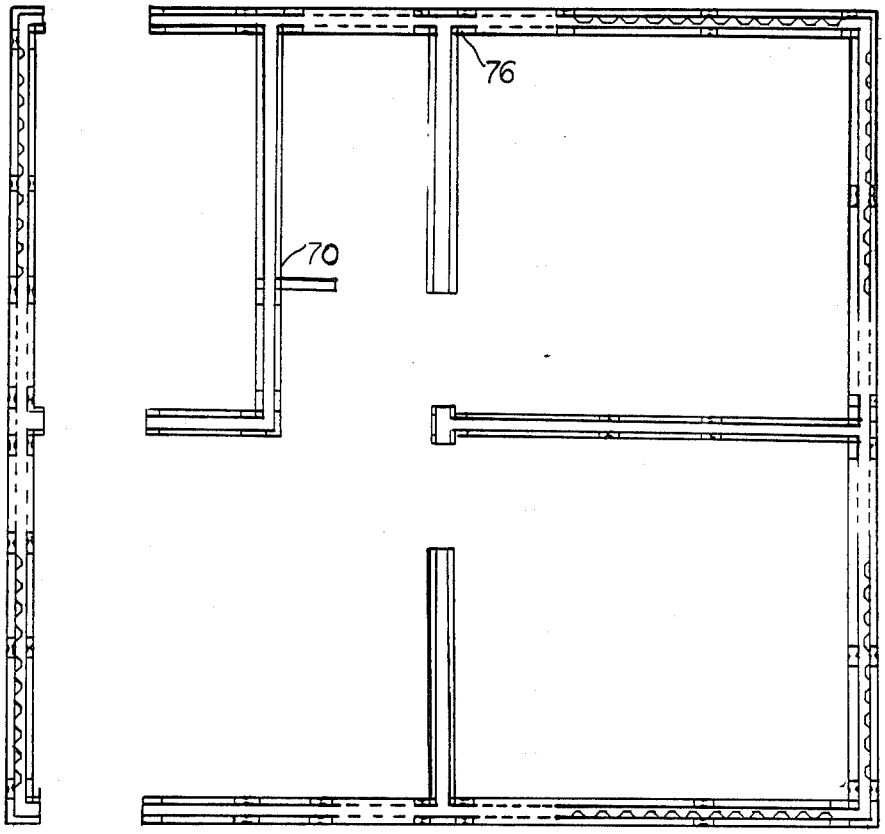
FIG. 15 is a floor plan illustrating the layout of a plank mold in accordance with the invention for the production of the interior walls of this building.
Figure 16:
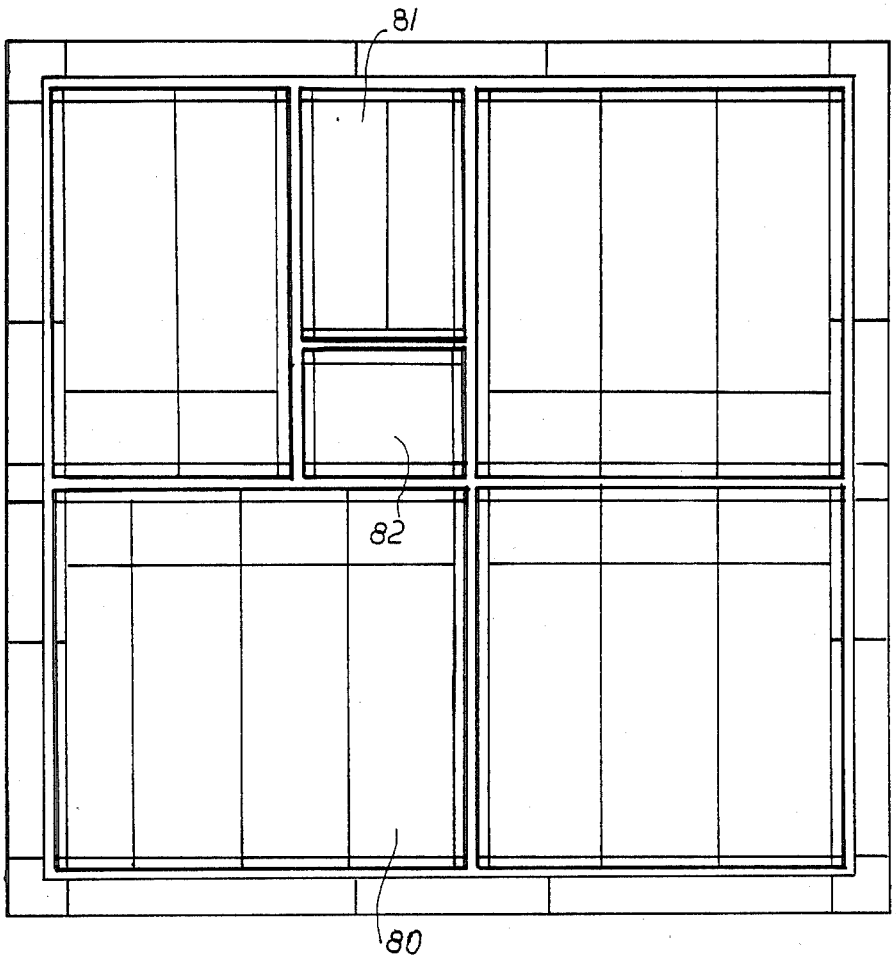
FIG. 16 is a plan view showing the layout of the plank mold elements of the roof in a preferred orientation.

FIG. 14A shows part of a mold prior to casting formed by modular elements 70, 71, 72 to defined the walls of the concrete structure and of elements 73 which provide a sloping roof. Similar elements 74 and 75 are used for the side walls (See FIG. 14B). The modular elements 70 can also be used within the interior together with corner elements as described in connection with FIGS. 6A and 6B and represented at 76 in FIG. 15 to provide a unitary building with interior and exterior walls being defined by corrugated panels while the interior walls are defined with smooth sheet panels as have been described. The plank molding thereof can be assembled from elements 80 in large sections or elements 81 in small sections, and an opening 82 can be formed therein by the means shown in FIGS. 11 through 13 for a skylight.

Figure 17A:
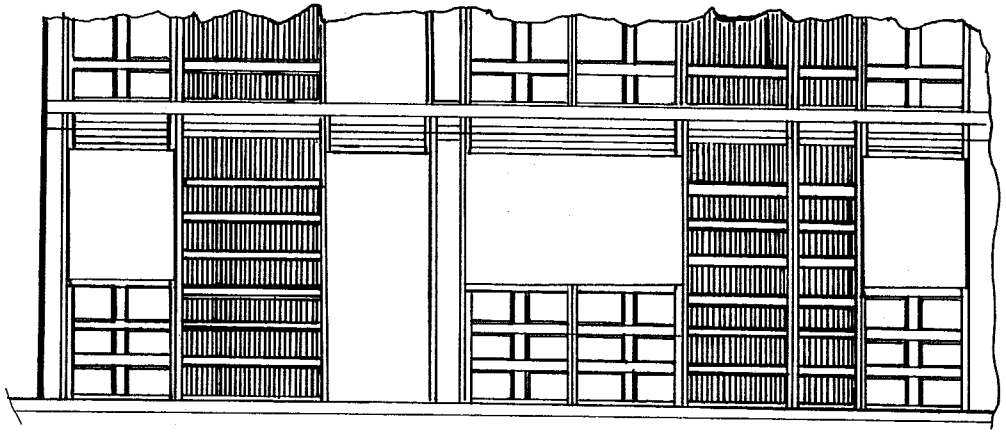
FIG. 17A is a view similar to FIG. 14A for a two-story building which can be used as a single family attached or unattached building, for multifamily housing, for a school, medical dispensary or shopping center.
Figure 17B:
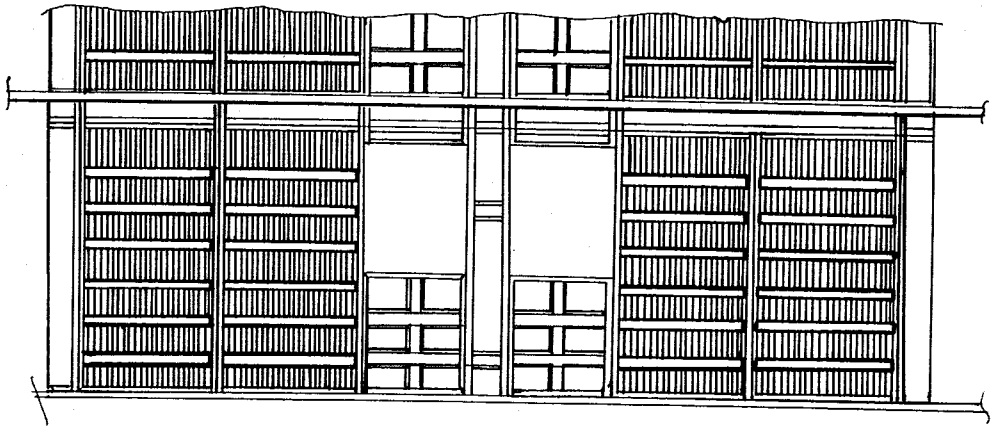
FIG. 17B is a side elevational view thereof.

FIGS. 17A and 17B have been provided to show that only two or more floors can be cast simultaneously.

I claim:

1. A falsework for concrete construction, comprising:

a plurality of plank elements, each having a rectangular sheet having a concrete-facing mold-forming side and a reverse side, a pair of flat tubular elements affixed to said sheet along opposite longitudinal edges thereof on said reverse side, said tubular elements each having a longitudinally extending outwardly projecting flange, and a plurality of equally spaced slots formed in a side of each of said elements turned away from said sheet and elongated in the longitudinal dimension of the respective element;

a coupling member interconnecting said plank elements with said flanges disposed in substantially contiguous relationship and two said tubular elements being substantially coplanar, said coupling member being formed as a generally rectangular plate overlying said sides of said coplanar tubular elements and formed with respective notches opening along a common edge of said plate in alignment with respective ones of said slots of said coplanar tubular elements; and respective hooks each having a short leg, a long leg connected to said short leg and parallel thereto, and an arm connecting said legs having a length substantially equal to the the sum of the thickness of said side and the thickness of said plate, said arm reaching through a respective slot and said short leg engaging the respective side of the respective tubular element on a face thereof turned away from said plate, said long leg engaging said plate on a face thereof turned away from said tubular elements and said arms being received in the respective said notches of said plate.

2. A system for the mass construction of a concrete building which comprises a reinforced concrete floor slab;

a falsework as defined in claim 1 on said slab and forming a mold defining interior and exterior walls of a structure and a roof thereof such that the formation of said walls and said roof can be effected in a single pouring operation of concrete in said mold.

3. The falsework defined in claim 1 wherein said plank elements have length and width dimensions which are integral multiples of 30 cm.

4. The falsework for concrete construction defined in claim 1 wherein said tubular elements are generally upright and below each of said slots engaged by a respective hook, a respective support bar is welded at a distance from a lower edge of said slot which is at most one-third of the height of said plate, said slots being of rectangular outline and of a height of about one-third of the height of said plate.

5. The falsework for concrete construction defined in claim 4 wherein said bars have a thickness substantially equal to that of said plate.

6. The falsework for concrete construction defined in claim 5 wherein said plate has a length substantially equal to twice the width of one of said tubular elements.

7. The falsework for concrete construction defined in claim 6 wherein said legs of said hook have rounded edges.

8. The falsework for concrete construction defined in claim 6 wherein said plank elements each have transverse elements extending in mutually parallel vertically spaced relationship between the tubular elements of the respective plank elements and affixed to the respective sheet thereof.

9. The falsework for concrete construction defined in claim 8 wherein said plank elements each is formed with respective vertical struts between pairs of said transverse elements of the respective plank element and affixed to the respective sheet thereof intermediate the respective tubular elements.

10. The falsework for concrete construction defined in claim 8 wherein said transverse elements of each plank element include upper and lower marginal transverse elements lying respectively along upper and lower edges of the plank element and formed with spaced apart slots each adapted to receive one of said hooks.

11. The falsework for concrete construction defined in claim 8, further comprising at least one end element adjoining at least one of said plank elements, said end element being formed with a rectangular sheet formed with two panels at a right angle to one another and having a concrete-facing mold-forming side and a reverse side, and respective tubular elements formed along edges of said panels and provided with said slots, said tubular element of a respective one of said panels being affixed to a tubular element of said one of said plank elements by a respective one of said bars and a respective pair of said hooks.

12. The falsework for concrete construction defined in claim 11 wherein said sheets are smooth.

13. As defined in claim 11 wherein said sheets are corrugated.

* * * * *